United States Patent [19]

Schreyer et al.

[11] 4,042,213

[45] Aug. 16, 1977

[54] ELECTRIC HOIST

[75] Inventors: Kenneth D. Schreyer, Clarence; Earl T. Leverentz, North Tonawanda; Thomas R. Nusz, Amherst, all of N.Y.

[73] Assignee: Columbus McKinnon Corporation, Tonawanda, N.Y.

[21] Appl. No.: 692,963

[22] Filed: June 4, 1976

[51] Int. Cl.[2] ..... B66D 1/00

[52] U.S. Cl. ..... 254/168; 254/174; 254/190 R; 212/39 R; 318/475

[58] Field of Search ..... 254/168, 167, 173 R, 254/174, 172, 190 R, 192, 186 R, 139; 212/39 DB, 39 MS, 39 R, 132, 134, 86; 200/85 R; 318/264, 475; 248/358 R, 18; 267/164, 153, 63 A

[56] References Cited

U.S. PATENT DOCUMENTS

| | | | |
|---|---|---|---|
| 3,095,979 | 7/1963 | Silberger | 212/134 |
| 3,994,476 | 11/1976 | Gennep | 254/173 R |

*Primary Examiner*—Robert J. Spar
*Assistant Examiner*—Kenneth Noland
*Attorney, Agent, or Firm*—Bean, Kauffman & Bean

[57] ABSTRACT

In a multiple-reeved electric hoist of the type employing either a load cable winding drum or a load chain lift wheel, and wherein the dead end of the cable (or chain) carries a part of the load and is attached to the hoist frame; an improved overload sensing and responsive power shut-off and overload impact distributing device associated with the dead-end of the load lift cable (or chain) for deenergizing the hoist motor and protecting the hoist parts and its supporting structure against damage whenever an overload is applied to the hoist lift cable (or chain).

6 Claims, 7 Drawing Figures

ELECTRIC HOIST

BACKGROUND AND OBJECTS OF THE INVENTION

Various devices are presently used for shutting off power to a motor of an electric hoist when there is an overload applied to the hoist load lift chain or cable, as evidenced for example by commonly assigned U.S. Pat. Nos. 3,075,134 and 3,728,502. More specifically, patent 3,075,134 is illustrative of an overload prevention device which is mounted within the casing of the hoist, and wherein the dead end 93 of the load lift cable is affixed to an overload sensing lever 90 which is pivotally mounted on the hoist casing as indicated at 91 (FIG. 1 of the patent); thereby concentrating all static and any reasonant vibrational loads transmitted through the cable 93 to the hoist casing at its points of connections with the pivot pin 91. Also, note that the mechanism of U.S. Pat. No. 3,075,134 operatively requires provision of a relay device such as is illustrated at 41 therein. U.S. Pat. No. 3,728,502 is illustrative of a type of overload protection device which is arranged externally of the hoist casing and therefore is not concerned with the problem which is dealt with by the present invention. However, note that the overload protection device of U.S. Pat. No. 3,728,502 requires provision of a variable spring characteristic type unit as illustrated at 64-60 in the drawing thereof.

The present invention is directed to an improved hoist construction which includes a self-contained overload prevention arrangement, which features a novel overload snubbing device in combination with a spring monitored snap action power supply control switch having circuit cutout and reset provisions occurring at different points along the path of travel of the switch actuator; the load snubber and the switch monitor mechanism cooperating to distribute static and/or dynamic overloads such as are transmitted through the load lift system to different portions of the hoist frame. Thus, the hoist motor as well as the frame of the hoist and the operative parts thereof are protected from overloads such as may be due either to attempts to statically overload the hoist or to dynamically induced overload conditions.

Other examples of prior art overload protection devices are found in U.S. Pat. No. 2,636,953; 3,095,979 and 3,233,746. However, it will be noted that the prior patents referred to and of which applicant is aware do not provide the improved combination load snubbing and load stress distribution results of the present invention.

THE DRAWING

DETAILED DESCRIPTION

Figure 1:
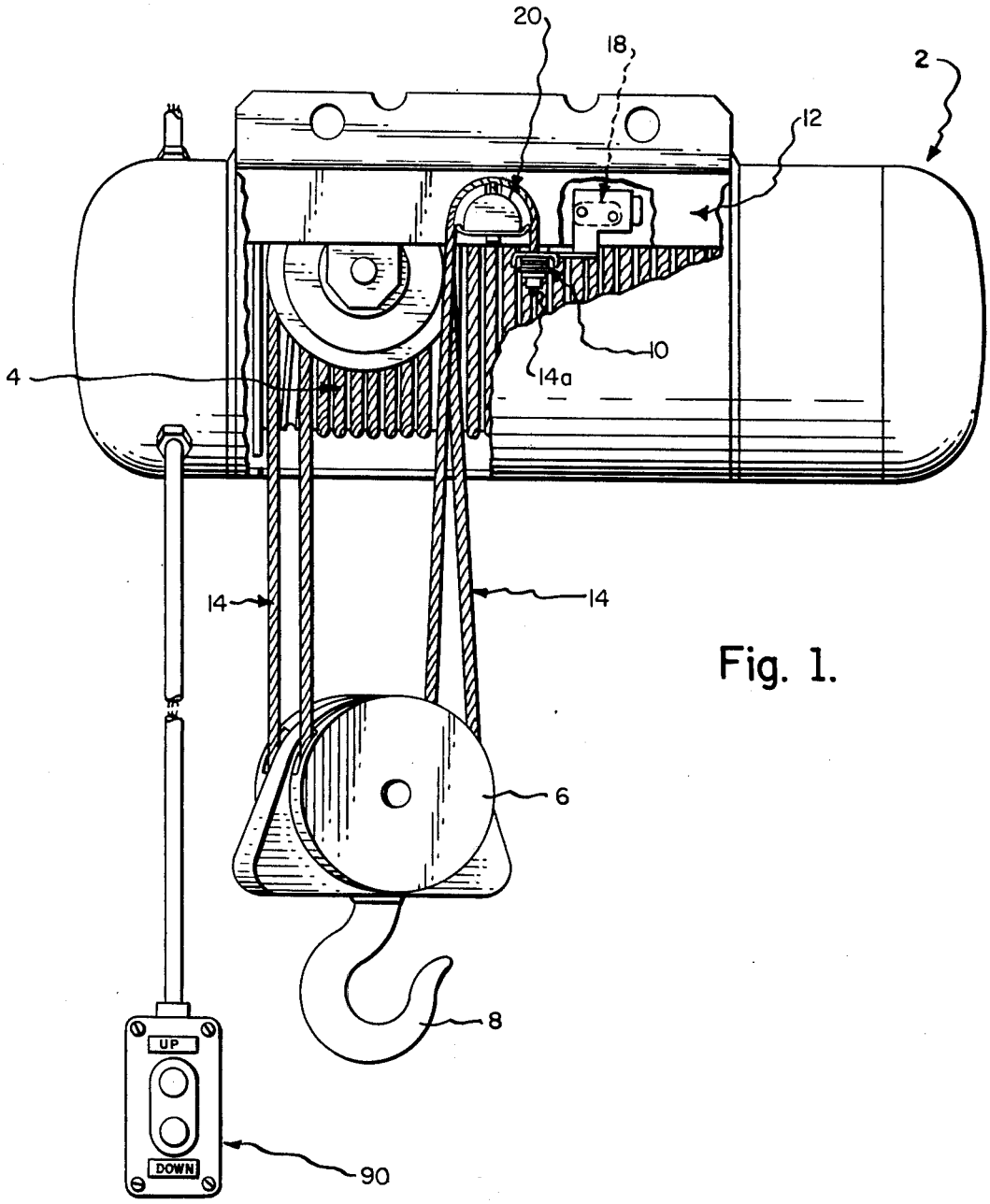
FIG. 1 is a side elevational view, with portions broken away to show the interior, of a cable type hoist embodying an overload sensing/preventing mechanism of the present invention.

As shown herein, the hoist of the invention is designated generally by the numeral 2 (FIG. 1) interiorly of which are mounted the hoist motor (not shown) and load lift cable winding drum 4. It is to be understood that whereas the drawing herewith illustrates the invention as being embodied in a cable type electric hoist, it is equally applicable to an electric chain hoist. In order to simplify the description of the invention hereinafter, reference will be made only to its application in a cable type hoist. In any case, the load lift cable (or chain) is multiple-reeved as illustrated at FIG. 1 to carry the load block 6 from which the load engaging hook 8 depends.

The overload sensing/prevention mechanism of the invention comprises by way of example as shown herein in combination, a compression spring device as illustrated generally at 10 which is based upon a stationary bracket portion 12 of the hoist frame and is centrally apertured to receive in freely threaded relation therethrough the hoist lift cable 14. More specifically, the mechanism 10 is based upon a stationary bracket 16 which is based upon a plate 24 rigidly extending from the hoist frame 12. The bracket 16 includes an upstanding arm 22 which serves to support the motor control switch 18, and is rigidly fixed to the hoist frame as by means of the cross plate 24. A switch actuator arm 26 is provided to transmit overload compression displacements of the spring unit 10 to the motor control switch 18 and carries at its upper end an adjustable screw 28 for operational contacts with the operating button 30 of the switch 18.

The spring unit 10 may be, as shown herein, in the form of a stack of Belleville type washers 32 centrally apertured as indicated at =*a* and vertically aligned radially offset apertures 32*b*; the washers 32 being arranged to straddle the cable 14. A retainer pin 34 having an enlarged lower end 34*a* slip-fits through apertures 32*b*. A bushing 36 having an enlarged lower end head portion 36*a* slip-fits interiorly of the washers 32 and is centrally bored to accommodate the cable 14. At its lower end the bracket 22 includes a horizontally disposed flange portion 38 which is apertured as shown at 40 and 42 to accommodate the upper ends of the retainer pin 34 and the bushing 36, respectively. Bracket 22 also includes a switch mounting flange portion 44 which vertically upstands from flange portion 38, and assembly guide flange portions 46*a*, 46*b* and 46*c* which depend from the flange portion 38 and serve to initially positionally locate member 26 and the washers 32 relative thereto. The member 26 includes a horizontally disposed mounting flange portion 48 which is through apertured at 50 and 52 to receive the lower ends of retainer pin 34 and bushing 36, respectively; and a switch operator mounting flange portion 55 which stands vertically from flange portion 48 to lie in a generally parallel and freely sliding or non-contacting relationship with switch mounting flange portion 44, as best shown in FIG. 3.

Figure 3:
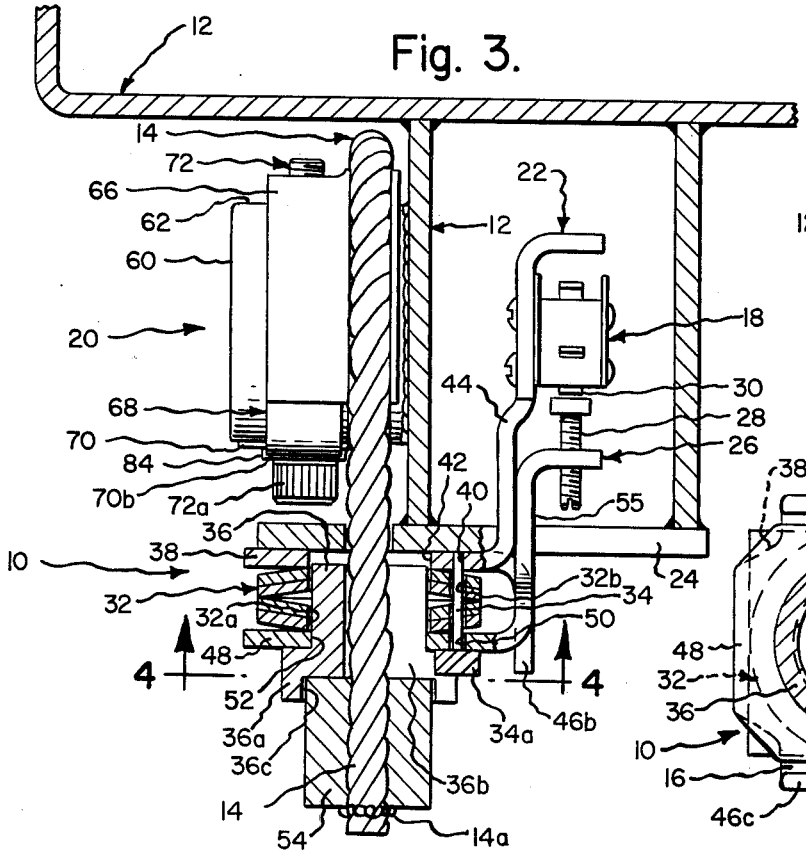
FIG. 3 is a fragmentary sectional view taken generally along the line 3—3 of FIG. 2.
Figure 4:
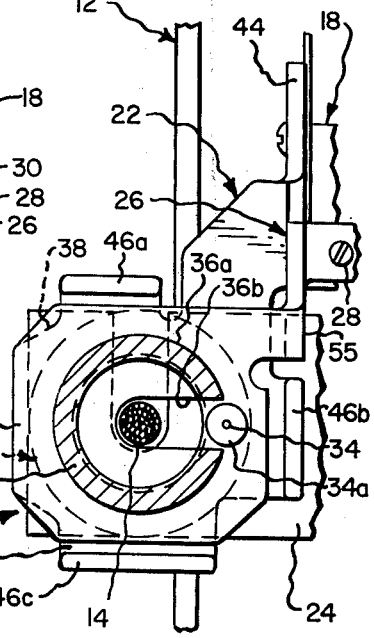
FIG. 4 is a fragmentary sectional view taken generally along the line 4—4 of FIG. 3.

By referring particularly to FIG. 3, it will be understood that the spring washers 32 are sandwiched between flange portions 38 and 48 and have their central openings 32*a* aligned to loosely and slidably receive bushings 36, which in turn has its upper and lower ends slidably received within apertures 42 and 52, respectively, and its enlarged head 36*a* arranged to bear against the lower surface of flange portion 48. Rotation of the washers relative to one another, as well as to flange portions 38 and 48, is prevented by the retainer pin 34 which is press-fitted upwardly through aperture 50 and aligned openings 32*b* into a press fit or otherwise fixed relationship within aperture 40 of flange portion 38. The enlarged head 34*a* of retainer pin 34 is initially arranged in underlying engagement with flange 48, whereby to retain flange portions 38 and 48 and washers 32 in an assembled relationship prior to assembly of the mechanism 10 within the hoist frame, while subsequently permitting displacement or movement of flange portion 48 upwardly towards flange portion 38 to effect compression of the spring unit comprising washers 32, as determined by hoist loading conditions. Retainer pin head portion 34*a* is also arranged to engage within bushing slot 36*b* in order to constrain bushing 36 from rotation relative to the above described assembly, as best shown in FIGS. 3 and 4.

Under hoist operating conditions the enlarged head 36*a* of bushing 36 is maintained in underlying engagement with flange portion 48 by a dead end spool or anchor 54, which is permanently fixed to the cable dead end 14*a* and is arranged to underengage head portion 36*a* within recess 36*c*. Thus, the funcion of retainer pin 34 is to afford a simple arrangement for maintaining the components of the sensing device 16 while in a partially assembled condition prior to installation within the hoist casing, and to thereafter prevent relative rotational movements of those components which might otherwise occur due to torsion stresses applied to the cable 14 such as to cause variations in the operating characteristics of the spring washers 32 and/or improper operation switch 18.

The switch 18 may be of any suitable commercially available snap action variety such as is generally disclosed for example in commonly assigned U.S. Pat. No. 3,728,502, wherein internal springs means (not shown) tend to hold the switch actuator button 30 in its illustrated downwardly directed extended position, for establishing an operating circuit through the hoist motor; while being deformable to allow actuator button travel under control of the operator 28 into an operating circuit cutout position for deenergizing the hoist motor. Switches of the type contemplated for such use in the present invention are further characterized by the fact that there is a substantial actuator button travel, eg. about 0.02 inches, between its cutout and its reset positions. A more detailed description of the mode of operation of this general type switch may be found in U.S. Pat. No. 2,840,657.

Figure 5:
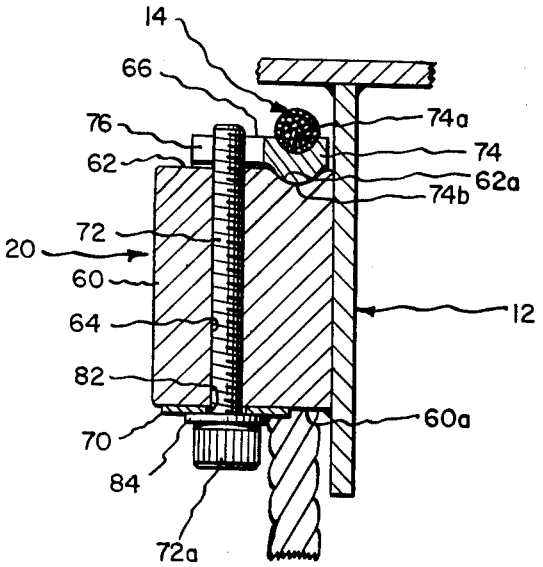
FIG. 5 is a fragmentary sectional view taken generally along the line 5—5 of FIG. 2.
Figure 6:
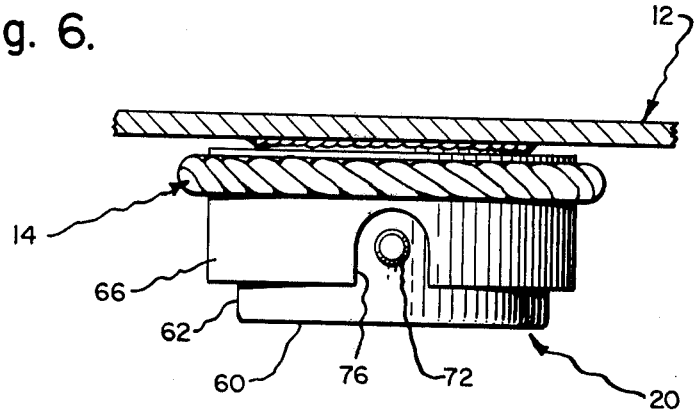
FIG. 6 is a fragmentary sectional view taken generally along the line 6—6 of FIG. 2.
Figure 7:
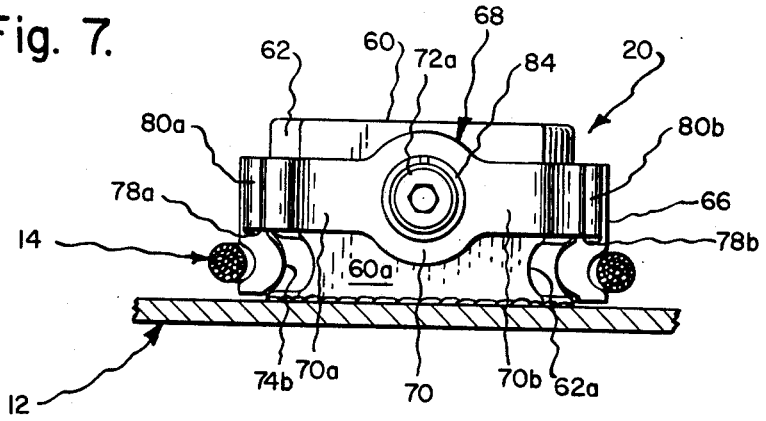
FIG. 7 is a fragmentary sectional view taken generally along the line 7—7 of FIG. 2.

As shown at FIGS. 2, 3 and 5–7, the snubbing device 20 includes a spool 60, which is rigidly fixed at its rear end as by welding to the hoist frame 12; and is formed with a parti-cylindrically shaped perimetral wall surface 62. The wall surface 62 is concave recessed as indicated at 62*a* (FIGS. 5–7). The spool 60 is formed with a vertically through, threaded, bore opening 64; and an arcuate shaped damping slipper shoe 66 is slidably journaled in the recess 62*a* as by means of a rib portion 74 (FIG. 5) for oscillatory rotational movements thereon. A plate spring 68 having a central mounting portion 70 and a pair of leg portions 70*a* 70*b* is mounted under the spool 60 by means of a bolt 72 which is threadably received within the opening 64.

The slipper shoe 66 is formed with an external groove 74*a* which is dimensioned to receive the cable 14, and a convex bearing or sliding surface 74*b* is positionally located within the bearing recess 62*a* ; and a centrally located and axially extending slot opening 76 which is dimensioned to loosely receive the end of bolt 72 as it projects upwardly above the surface 62. The opposite ends of the slipper shoe 66 are formed with axially extending and annularly opening recesses 78*a* and 78*b*, which are dimensioned to receive opposite rolled ends 80*a* and 80*b* of the spring 68. Preferably, the damping slipper shoe 66 is formed of a plastic material which is lubric by nature and has a uniform coefficient of friction in order to provide for semi-free (damping) sliding movements thereof within the bearing recess 62*a*. The mounting portion 70 of the slipper shoe spring 68 is formed with a through opening 82 (FIG. 5), which is dimensioned to receive the bolt 72. The enlarged head 72*a* of the bolt and lock washer 84 are employed to clamp the plate spring in engagement with the flat, horizontally disposed lower surface 60*a* of the spool 60.

The mechanism 10 serves to protect the hoist system from damage and/or failure occasioned by the occurrence of any overload condition. An overload condition may occur either when an operator attempts to lift a load which is in excess of the rated load of the hoist system, or when a load being lifted (which is equal to or less than the rated load) undergoes dynamic overloading conditions. All hoist systems are subject to the occurrence of such dynamic load conditions, as a result of which static loads substantially less than the rated load of a system may periodically produce actual loads on the system exceeding the capacities thereof.

Figure 2:
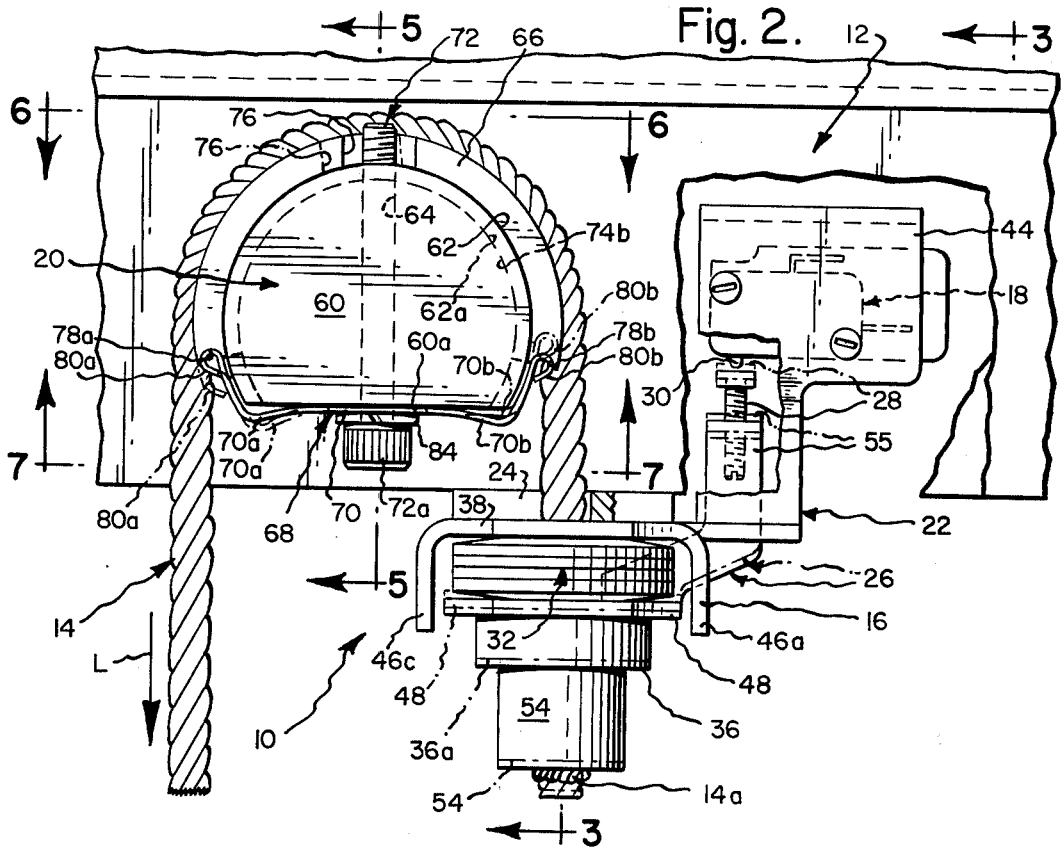
FIG. 2 is a fragmentary illustration on enlarged scale of the overload prevention mechanism of the present invention as incorporated internally of the otherwise conventional type multiple-reeved-cable electric hoist as shown in FIG. 1.

In FIG. 2 of the drawing herewith the rest and overload conditions of mechanism 10 are shown in full and broken lines, respectively. Mechanism 10 assumes its rest condition, whenever there is no operational load on the cable 14 and the hoist motor is deenergized by the hoist operator control as indicated at 90 (FIG. 1); cable 14 being then maintained under a minimum tension condition such as by the weight of the conventionally attached block 6 and hook 8 which serves to removably connect cable 14 to loads to be lifted. In this rest condition of mechanism 10, the slipper shoe 66 is roughly centered relative to the surface 62 as viewed in FIG. 2 and dead end spool 54 is maintained in underengagement with bushing 36*a*, whereby to maintain serial contact between bushing 36*a*, plate 48, washers 32 and plate 38, without producing any significant or appreciable pre-loading of the spring washers.

The mechanism 10 assumes its overload condition whenever an overload is applied to cable 14. In an overload condition cable 14 is displaced by the applied load (or actual load) so that the slipper shoe is moved counter-clockwise (FIG. 2) relative to surface 62; dead end spool 54 being thereby displaced upwardly to effect compression of the spring washers 32 and movement of plate 48 sufficiently to cause screw operator 28 to effect movement of actuator button 30 into its switch cutout position, as best shown by phantom lines in FIG. 2.

More specifically, it will be understood that the washers 32 are sized and arranged such that they will undergo a given amount of deflection upon the occurrence of an overload condition; and screw operator 28 is so adjusted relative to plate 26 that switch 18 wil be in cutout position to effect deenergization of the hoist motor control circuit whenever the washers 32 undergo such given amount of deflection. Thus, the deflection characteristics of the spring washers and the length of switch cutout travel of actuator button 30 will determine whether the screw operator 28 is arranged in initial engagement with or spaced from actuator button 30 when the mechanism 10 is in its rest condition.

As previously indicated, switch 18 is operated to deenergize the motor control circuit whereby to terminate a load lifting operation whenever mechanism 10 senses the occurrence of an overload condition. In that switch 18 is characterized as having substantial actuator travel between its cutout and reset positions, substantially all of the load producing an overload condition must be removed from the hoist in order to permit resetting of the switch and thus reenergization of the hoist motor for load lifting purposes. Furthermore, since resetting of switch 18 is designed to occur at a loading condition substantially below the lower limit of the load range such as would produce an overload condition, hunting (jerky or spasmodic stopping and starting) action of the hoist under normal operating conditions is effectively prevented. It is to be understood that the operator control 90 will include a load lowering control circuit, which is independent of the load lifting control circuit including switch 18, so that after switch 18 has been opened due to the occurrence of an overload, the load causing the overload condition may be lowered for purposes of removing the overload whereupon the switch 18 will automatically reset.

Whereas the slipper shoe 66 is externally grooved so as to accommodate the lift cable 14 when under load in snuggly fitted relation therein while being parti-frictionally journaled in the spool 60, whenever an overload condition occurs the pull upon the dead end of the cable will cause the spring unit 32 to compress while the slipper shoe 66 rotates counter-clockwise on the spool as viewed in FIG. 2. against the bias of the leaf spring 68. The motor control switch 18 is thereupon actuated to deenergize the hoist motor, whereupon the operator pushes the down button of the pendant control 90 so as to relieve the hoist system of its load. Then, as the cable 14 relaxes its snubbing effect relative to the spool 60 the spring 68 is enabled to restore the slipper shoe 66 to its normal position on the spool.

Hence, intermediate of each snubbing action of the slipper shoe relative to the spool it is automatically restored to its normal position; and thus it will be appreciated that an important feature of this arrangement of the invention resides in the fact that when an overload condition is transmitted through the cable to the hoist frame the overload shock is shared between the unit 10 and the snubbing spool 60, and is thereby distributed to different parts of the hoist frame. This combination cushioning and distributing effect eliminates shock load concentrations upon the hoist operating parts including the hoist drive motor, as well as the frame parts and hoist supporting structure.

We claim:

1. In a multiple-reeved electric hoist having a frame and wherein dead end of the load carrying cable or chain is attached to said hoist frame, an improved combination overload snubbing and overload sensing and motor control mechanism;

said overload snubbing mechanism including a load snubbing spool positionally affixed to a first portion of said hoist frame and having a generally arcuate shaped slipper shoe frictionally journaled thereon for retarded oscillation thereabout, the hoisting cable or chain being arranged in training relation around said slipper shoe, and a first spring device mounted in association with said slipper shoe and operable to resiliently bias said slipper shoe to remain in a normal centralized position relative to said spool;

said overload motor control mechanism comprising a motor power supply control switch unit positionally affixed to said hoist frame;

said overload sensing mechanism comprising a second spring device which is bottomed against a second portion of said hoist frame;

the extreme dead end portion of said cable or chain being arranged to terminate in operable connection with the displaceable portion of said second spring device; and a switch actuating arm rigidly extending from the displaceable portion of said second spring device and operatively associated with said control switch unit so as to actuate the latter to deenergize the hoist motor whenever a hoist overload is transmitted to the mechanism through the hoist cable or chain.

2. In an electric hoist having an improved mechanism as set forth in claim 1, wherein said slipper shoe is formed of wear-resistant plastic material.

3. In an electric hoist having an improved mechanism as set forth in claim 1, wherein said first spring device comprises a leaf type spring.

4. In an electric hoist having an improved mechanism as set forth in claim 1, wherein said second spring device includes a stack of Belleville type spring washers whereby to comprise a compression spring device which is centrally apertured and through which the dead end portion of said cable or chain is threaded.

5. In an electric hoist having an improved mechanism as set forth in claim 4, wherein said second spring device includes closure members at opposite ends of said stack of spring washers, said closure members being interconnected by holding means preventing their disassembly of said second spring device when in unloaded condition.

6. In an electric hoist having an improved mechanism as set forth in claim 5, wherein said holding means also prevents relative rotational movements of the components of said second spring device.

* * * * *

UNITED STATES PATENT AND TRADEMARK OFFICE

CERTIFICATE OF CORRECTION

PATENT NO. : 4,042,213

DATED : August 16, 1977

INVENTOR(S) : Kenneth D. Schreyer, Earl T. Leverentz and Thomas R. Nusz

It is certified that error appears in the above-identified patent and that said Letters Patent are hereby corrected as shown below:

Column 2, line 41, change "=a" to ---32a---.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*